US011830450B2

(12) United States Patent
Hai

(10) Patent No.: US 11,830,450 B2
(45) Date of Patent: Nov. 28, 2023

(54) METHOD FOR ADJUSTING DARK-STATE VOLTAGE APPLIED ON LIQUID CRYSTAL DISPLAY PANEL, DEVICE, AND STORAGE MEDIUM

(71) Applicant: Shenzhen China Star Optoelectronics Semiconductor Display Technology Co., LTD., Guangdong (CN)

(72) Inventor: Bo Hai, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 565 days.

(21) Appl. No.: 17/043,109

(22) PCT Filed: Aug. 4, 2020

(86) PCT No.: PCT/CN2020/106679
§ 371 (c)(1),
(2) Date: Sep. 29, 2020

(87) PCT Pub. No.: WO2021/253588
PCT Pub. Date: Dec. 23, 2021

(65) Prior Publication Data

US 2023/0108203 A1 Apr. 6, 2023

(30) Foreign Application Priority Data

Jun. 16, 2020 (CN) ..... 202010549367.4

(51) Int. Cl.
*G09G 5/10* (2006.01)
*G09G 3/36* (2006.01)

(52) U.S. Cl.
CPC ..... *G09G 3/36* (2013.01); *G09G 2320/0247* (2013.01); *G09G 2320/066* (2013.01); *G09G 2360/14* (2013.01); *G09G 2360/16* (2013.01)

(58) Field of Classification Search
CPC ..... G09G 3/36; G09G 2320/0247; G09G 2320/066; G09G 2360/14; G09G 2360/16
(Continued)

(56) References Cited

U.S. PATENT DOCUMENTS 5,850,205 A 12/1998 Blouin
2007/0290970 A1 12/2007 Liu et al.
(Continued)

FOREIGN PATENT DOCUMENTS

CN 101151574 A 3/2008
CN 101520992 A 9/2009
(Continued)

*Primary Examiner* — Jennifer T Nguyen

(57) ABSTRACT

A method for adjusting dark-state voltage applied on a liquid crystal panel, a dark-state voltage adjusting device and a storage medium are proposed. The method includes: obtaining a plurality of initial dark-state voltage differences; obtaining a contrast ratio corresponding to each of the initial dark-state voltage differences based on the plurality of initial dark-state voltage differences; obtaining a reference dark-state voltage difference in the plurality of initial dark-state voltage differences, and obtaining a contrast ratio change corresponding to each of the initial dark-state voltage differences based on the reference dark-state voltage difference; and determining a dark-state voltage difference of the LCD panel based on the contrast ratio change corresponding to each of the initial dark-state voltage differences.

20 Claims, 6 Drawing Sheets

(58) Field of Classification Search
USPC ..... 345/690
See application file for complete search history.

(56) References Cited

U.S. PATENT DOCUMENTS

| | | | | |
|---|---|---|---|---|
| 2008/0024412 | A1 | 1/2008 | Nose | |
| 2009/0167671 | A1 | 7/2009 | Kerofsky | |
| 2012/0062619 | A1 | 3/2012 | Miyasaka | |
| 2012/0299981 | A1 | 11/2012 | Origuchi | |
| 2014/0368562 | A1 | 12/2014 | Kim et al. | |
| 2015/0009243 | A1 | 1/2015 | Onoyama et al. | |
| 2016/0260392 | A1* | 9/2016 | Yamazaki | G09G 3/3607 |
| 2017/0048946 | A1 | 2/2017 | Baek et al. | |
| 2017/0092204 | A1 | 3/2017 | Kim et al. | |
| 2018/0059458 | A1 | 3/2018 | Chen | |
| 2019/0035345 | A1 | 1/2019 | Jinta et al. | |
| 2020/0160801 | A1* | 5/2020 | Wang | H04N 1/4078 |
| 2020/0341338 | A1 | 10/2020 | Ma et al. | |

FOREIGN PATENT DOCUMENTS

| | | | | |
|---|---|---|---|---|
| CN | 101719351 | A | 6/2010 | |
| CN | 101911169 | A | 12/2010 | |
| CN | 102081907 | A | 6/2011 | |
| CN | 102402966 | * | 12/2011 | G09G 3/36 |
| CN | 102402966 | A | 4/2012 | |
| CN | 102592529 | A | 7/2012 | |
| CN | 102687191 | A | 9/2012 | |
| CN | 103763537 | A | 4/2014 | |
| CN | 104282260 | A | 1/2015 | |
| CN | 105529008 | A | 4/2016 | |
| CN | 106154668 | A | 11/2016 | |
| CN | 106297633 | A | 1/2017 | |
| CN | 108496217 | A | 9/2018 | |
| CN | 108924533 | A | 11/2018 | |
| CN | 109240004 | A | 1/2019 | |
| CN | 109686324 | A | 4/2019 | |
| CN | 109949754 | A | 6/2019 | |
| CN | 110473499 | A | 11/2019 | |
| JP | 2020008677 | A | 1/2020 | |
| KR | 20180002966 | A | 1/2018 | |
| WO | 2014017329 | A1 | 1/2014 | |

* cited by examiner

METHOD FOR ADJUSTING DARK-STATE VOLTAGE APPLIED ON LIQUID CRYSTAL DISPLAY PANEL, DEVICE, AND STORAGE MEDIUM

BACKGROUND

1. Field of the Invention

The present disclosure relates to the field of display technology, more particularly, to a dark-state voltage adjusting method for a liquid crystal display (LCD) panel, a device, and a storage medium.

2. Description of the Related Art

LCD panels have been widely used in display products, such as mobile phones, smart monitors, LCD TVs, personal computers, etc., due to their advantages of slimness, high brightness, and low radiation. During the operating process of the LCD panel, in order to prevent the orientation of the liquid crystal molecules from being fixed in one direction to cause characteristic damages, the display voltages in the LCD panel are divided into a positive-polarity voltage and a negative-polarity voltage. When the voltage of the display electrode is higher than the voltage of the common electrode, it is called a positive-polarity voltage. When the voltage of the display electrode is lower than the voltage of the common electrode, it is called a negative-polarity voltage. Each gray level of the LCD panel corresponds to a positive-polarity voltage and a negative-polarity voltage.

Generally, the positive-polarity and negative-polarity voltages of each gray level of the LCD panel can be adjusted and determined according to a VT curve (transmittance curve) or a target brightness curve, etc. However, due to the wide range from which the dark-state voltage can take its value, the dark-state voltage difference (the difference between the positive-polarity voltage and the negative-polarity voltage) is more difficult to be determined, which in turn affects the contrast of the LCD panel.

SUMMARY

The embodiment of the present disclosure provides a dark-state voltage adjusting method for an LCD panel, a device, and a storage medium to specify the dark-state voltage difference of the LCD panel so as to improve the contrast ratio of the LCD panel.

The present disclosure provides a dark-state voltage adjusting method for an LCD panel. The dark-state voltage adjusting method for the LCD panel comprises: obtaining a plurality of initial dark-state voltage differences; obtaining a contrast ratio corresponding to each of the initial dark-state voltage differences based on the plurality of initial dark-state voltage differences; obtaining a reference dark-state voltage difference in the plurality of initial dark-state voltage differences, and obtaining a contrast ratio change corresponding to each of the initial dark-state voltage differences based on the reference dark-state voltage difference; and determining a dark-state voltage difference of the LCD panel based on the contrast ratio change corresponding to each of the initial dark-state voltage differences.

Optionally, the step of obtaining the plurality of initial dark-state voltage differences comprises: obtaining adjustment parameters; and adjusting a dark-state voltage based on the adjustment parameters to obtain the plurality of initial dark-state voltage differences.

Optionally, the step of obtaining the contrast ratio corresponding to each of the initial dark-state voltage differences based on the plurality of initial dark-state voltage differences comprises: obtaining the dark-state voltage corresponding to each of the initial dark-state voltage differences; and obtaining the contrast ratio corresponding to each of the initial dark-state voltage differences based on the dark-state voltage corresponding to each of the initial dark-state voltage differences.

Optionally, the step of obtaining the reference dark-state voltage difference in the plurality of initial dark-state voltage differences, and obtaining the contrast ratio change corresponding to each of the initial dark-state voltage differences based on the reference dark-state voltage difference comprises: obtaining a contrast ratio corresponding to the reference dark-state voltage difference and the contrast ratio corresponding to each of the initial dark-state voltage differences; and calculating the contrast ratio change corresponding to each of the initial dark-state voltage differences based on the contrast ratio corresponding to the reference dark-state voltage difference and the contrast ratio corresponding to each of the initial dark-state voltage differences.

Optionally, the step of calculating the contrast ratio change corresponding to each of the initial dark-state voltage differences based on the contrast ratio corresponding to the reference dark-state voltage difference and the contrast ratio corresponding to each of the initial dark-state voltage differences comprises: calculating a contrast ratio difference between the contrast ratio corresponding to each of the initial dark-state voltage differences and the contrast ratio corresponding to the reference dark-state voltage difference; and calculating a ratio of the contrast ratio difference corresponding to each of the initial dark-state voltage differences to the contrast ratio corresponding to the reference dark-state voltage difference to obtain the contrast ratio change corresponding to each of the initial dark-state voltage differences.

Optionally, the step of calculating the contrast ratio change corresponding to each of the initial dark-state voltage differences based on the contrast ratio corresponding to the reference dark-state voltage difference and the contrast ratio corresponding to each of the initial dark-state voltage differences comprises: calculating a ratio of the contrast ratio corresponding to each of the initial dark-state voltage differences to the contrast ratio corresponding to the reference dark-state voltage difference to obtain the contrast ratio change corresponding to each of the initial dark-state voltage differences.

Optionally, the step of determining the dark-state voltage difference of the LCD panel based on the contrast ratio change corresponding to each of the initial dark-state voltage differences comprises: obtaining a reference contrast ratio change; and determining the initial dark-state voltage difference as the dark-state voltage difference of the LCD panel when the contrast ratio change corresponding to the initial dark-state voltage difference and the reference contrast ratio change satisfy a preset condition.

Correspondingly, the present disclosure provides a dark-state voltage adjusting device for an LCD panel. The dark-state voltage adjusting device for the LCD panel comprises:

- an acquisition module configured to obtain a plurality of initial dark-state voltage differences;
- a first arithmetic module configured to obtain a contrast ratio corresponding to each of the initial dark-state voltage differences based on the plurality of initial dark-state voltage differences;

a second arithmetic module configured to obtain a reference dark-state voltage difference in the plurality of initial dark-state voltage differences, and obtain a contrast ratio change corresponding to each of the initial dark-state voltage differences based on the reference dark-state voltage difference; and a value selection module configured to determine a dark-state voltage difference of the LCD panel based on the contrast ratio change corresponding to each of the initial dark-state voltage differences.

Optionally, the acquisition module comprises a first acquisition unit and an adjustment unit; the first acquisition unit being configured to obtain adjustment parameters; and the adjustment unit being configured to adjust a dark-state voltage based on the adjustment parameters to obtain the plurality of initial dark-state voltage differences.

Optionally, the first arithmetic module comprises a second acquisition unit and a first calculation unit; the second acquisition unit being configured to obtain the dark-state voltage corresponding to each of the initial dark-state voltage differences; and the first calculation unit being configured to calculate and obtain the contrast ratio corresponding to each of the initial dark-state voltage differences based on the dark-state voltage corresponding to each of the initial dark-state voltage differences.

Optionally, the second arithmetic module comprises a third acquisition unit and a second calculation unit;

the third acquisition unit being configured to obtain a contrast ratio corresponding to the reference dark-state voltage difference and the contrast ratio corresponding to each of the initial dark-state voltage differences; and the second calculation unit being configured to calculate the contrast ratio change corresponding to each of the initial dark-state voltage differences based on the contrast ratio corresponding to the reference dark-state voltage difference and the contrast ratio corresponding to each of the initial dark-state voltage differences.

Optionally, the second calculation unit is configured to calculate a contrast ratio difference between the contrast ratio corresponding to each of the initial dark-state voltage differences and the contrast ratio corresponding to the reference dark-state voltage difference; and calculate a ratio of the contrast ratio difference corresponding to each of the initial dark-state voltage differences to the contrast ratio corresponding to the reference dark-state voltage difference to obtain the contrast ratio change corresponding to each of the initial dark-state voltage differences.

Optionally, the second calculation unit is configured to calculate a ratio of the contrast ratio corresponding to each of the initial dark-state voltage differences to the contrast ratio corresponding to the reference dark-state voltage difference to obtain the contrast ratio change corresponding to each of the initial dark-state voltage differences.

Optionally, the value selection module comprises a fourth acquisition unit and a comparing unit;

the fourth acquisition unit being configured to obtain a reference contrast ratio change; and the comparing unit being configured to compare the contrast ratio change corresponding to each of the initial dark-state voltage differences with the reference contrast ratio change, and determine the initial dark-state voltage difference as the dark-state voltage difference of the LCD panel when the contrast ratio change corresponding to the initial dark-state voltage difference and the reference contrast ratio change satisfy a preset condition.

Correspondingly, the present disclosure provides a storage medium storing a plurality of instructions, the instructions being adapted to be loaded by a processor to perform operations of:

adjusting dark-state voltage applied on a liquid crystal (LCD) panel comprising:

obtaining a plurality of initial dark-state voltage differences;

obtaining a contrast ratio corresponding to each of the initial dark-state voltage differences based on the plurality of initial dark-state voltage differences;

obtaining a reference dark-state voltage difference in the plurality of initial dark-state voltage differences, and obtaining a contrast ratio change corresponding to each of the initial dark-state voltage differences based on the reference dark-state voltage difference; and determining a dark-state voltage difference of the LCD panel based on the contrast ratio change corresponding to each of the initial dark-state voltage differences.

Optionally, the operation of obtaining the plurality of initial dark-state voltage differences comprises:

obtaining adjustment parameters; and adjusting a dark-state voltage based on the adjustment parameters to obtain the plurality of initial dark-state voltage differences.

Optionally, the operation of obtaining the contrast ratio corresponding to each of the initial dark-state voltage differences based on the plurality of initial dark-state voltage differences comprises:

obtaining the dark-state voltage corresponding to each of the initial dark-state voltage differences; and obtaining the contrast ratio corresponding to each of the initial dark-state voltage differences based on the dark-state voltage corresponding to each of the initial dark-state voltage differences.

Optionally, the operation of obtaining the reference dark-state voltage difference in the plurality of initial dark-state voltage differences, and obtaining the contrast ratio change corresponding to each of the initial dark-state voltage differences based on the reference dark-state voltage difference comprises:

obtaining a contrast ratio corresponding to the reference dark-state voltage difference and the contrast ratio corresponding to each of the initial dark-state voltage differences; and calculating the contrast ratio change corresponding to each of the initial dark-state voltage differences based on the contrast ratio corresponding to the reference dark-state voltage difference and the contrast ratio corresponding to each of the initial dark-state voltage differences.

Optionally, the operation of calculating the contrast ratio change corresponding to each of the initial dark-state voltage differences based on the contrast ratio corresponding to the reference dark-state voltage difference and the contrast ratio corresponding to each of the initial dark-state voltage differences comprises:

calculating a contrast ratio difference between the contrast ratio corresponding to each of the initial dark-state voltage differences and the contrast ratio corresponding to the reference dark-state voltage difference; and calculating a ratio of the contrast ratio difference corresponding to each of the initial dark-state voltage differences to the contrast ratio corresponding to the reference dark-state voltage difference to obtain the contrast ratio change corresponding to each of the initial dark-state voltage differences.

Optionally, the operation of determining the dark-state voltage difference of the LCD panel based on the contrast ratio change corresponding to each of the initial dark-state voltage differences comprises:

obtaining a reference contrast ratio change; and determining the initial dark-state voltage difference as the dark-state voltage difference of the LCD panel when the contrast ratio change corresponding to the initial dark-state voltage difference and the reference contrast ratio change satisfy a preset condition.

The present disclosure provides a dark-state voltage adjusting method for an LCD panel, a device and a storage medium. The present method obtains a plurality of initial dark-state voltage differences, and obtains a contrast ratio corresponding to each of the initial dark-state voltage differences based on the plurality of initial dark-state voltage differences. After that, a reference dark-state voltage difference is obtained, and a contrast ratio change corresponding to each of the initial dark-state voltage differences is obtained based on the reference dark-state voltage difference. Finally, a dark-state voltage difference of the LCD panel is determined based on the contrast ratio change corresponding to each of the initial dark-state voltage differences. The present method specifies the dark-state voltage difference of the LCD panel. As a result, the contrast ratio of the LCD panel is improved.

BRIEF DESCRIPTION OF THE DRAWINGS

To describe the technical solutions in the embodiments of this application more clearly, the following briefly introduces the accompanying drawings required for describing the embodiments. Apparently, the accompanying drawings in the following description show merely some embodiments of this application, and a person of ordinary skill in the art may still derive other drawings from these accompanying drawings without creative efforts.

DESCRIPTION OF THE EMBODIMENTS

For the purpose of description rather than limitation, the following provides such specific details as a specific system structure, interface, and technology for a thorough understanding of the application. However, it is understandable by persons skilled in the art that the application can also be implemented in other embodiments not providing such specific details. In other cases, details of a well-known apparatus, circuit and method are omitted to avoid hindering the description of the application by unnecessary details.

The term "first", "second" are for illustrative purposes only and are not to be construed as indicating or imposing a relative importance or implicitly indicating the number of technical features indicated. Thus, a feature that limited by "first", "second" may expressly or implicitly include at least one of the features. In the description of the present disclosure, the meaning of "plural" is two or more, unless otherwise specifically defined.

The dark-state voltage adjusting method for the LCD panel according to the embodiment of the present disclosure obtains a plurality of initial dark-state voltage differences, and obtains a contrast ratio corresponding to each of the initial dark-state voltage differences based on the plurality of initial dark-state voltage differences. After that, a reference dark-state voltage difference in the plurality of initial dark-state voltage differences is obtained, and a contrast ratio change corresponding to each of the initial dark-state voltage differences is obtained based on the reference dark-state voltage difference. Finally, a dark-state voltage difference of the LCD panel is determined based on the contrast ratio change corresponding to each of the initial dark-state voltage differences. The present method can determine the dark-state voltage difference of the LCD panel through the relationship between each of the initial dark-state voltage differences and the corresponding contrast ratio change to specify the dark-state voltage difference of the LCD panel. As a result, the contrast ratio of the LCD panel is improved.

Figure 1:
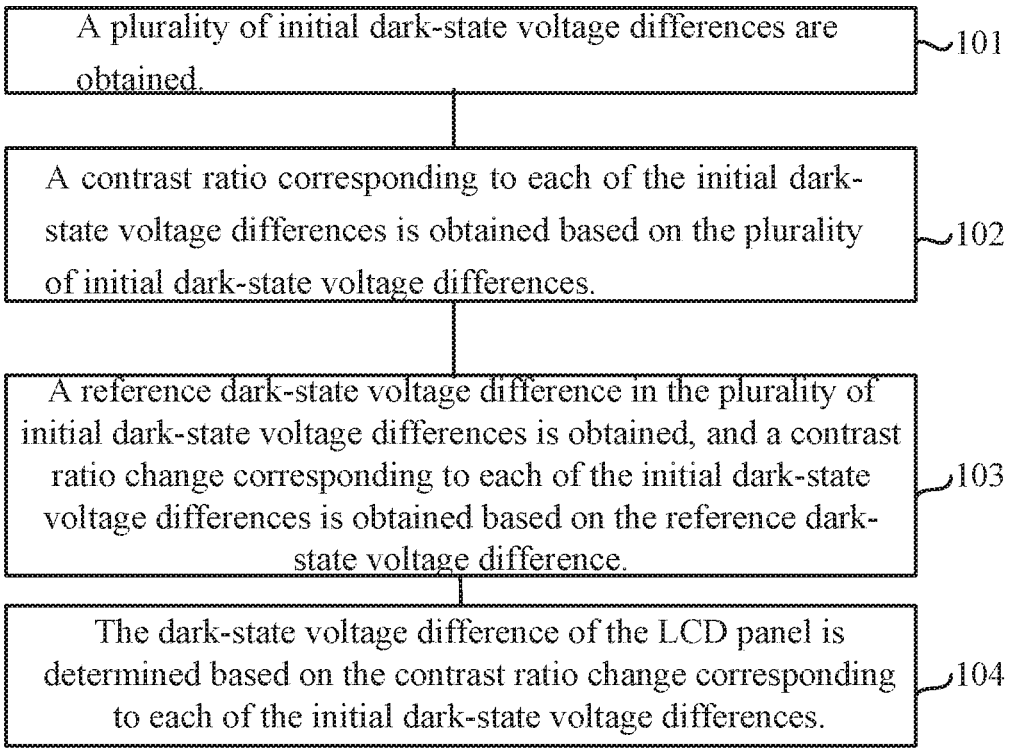
FIG. 1 is a first schematic flowchart of a dark-state voltage adjusting method for an LCD panel according to one embodiment of the present disclosure.

A description is provided with reference to FIG. 1. FIG. 1 is a schematic flowchart of a dark-state voltage adjusting method for an LCD panel according to one embodiment of the present disclosure. The dark-state voltage adjusting method for the LCD panel comprises the following steps:

101. A plurality of initial dark-state voltage differences are obtained.

A dark-state voltage comprises a first voltage and a second voltage. The first voltage is higher than a common electrode voltage. The second voltage is lower than the common electrode voltage. The dark-state voltage difference is equal to a difference between the first voltage and the second voltage. Through reversely adjusting the first voltage and the second voltage, the plurality of initial dark-state voltage differences can be obtained. It is noted that the dark-state voltage when the dark-state voltage difference is zero can be the smallest voltage of the initial gamma voltage of the LCD panel. The dark-state voltage when the dark-state voltage difference is zero can also be the voltage that makes the LCD panel have the lowest brightness.

Figure 2:
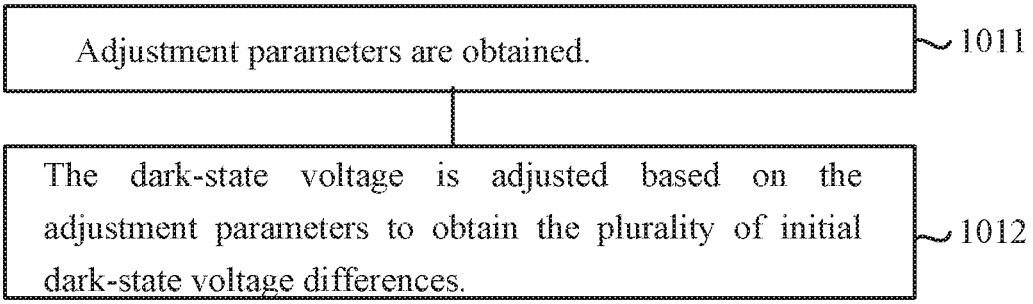
FIG. 2 is a schematic flowchart of step 101 in FIG. 1.

A description is provided with reference to FIG. 2. Step 101 comprises:

1011. Adjustment parameters are obtained.

The adjustment parameters comprise a first adjustment parameter and a second adjustment parameter. The first adjustment parameter and the second adjustment parameter may be set depending on practical needs. In some embodiments, the first adjustment parameter is the same as the second adjustment parameter. It can be understood that the first voltage and the second voltage are symmetrical with respect to the common electrode voltage under ideal conditions. At this time, the brightness of the LCD panel respectively driven by the first voltage and the second voltage is equal, which can reduce flickering. However, during the practical manufacturing process, the first voltage and the second voltage are asymmetrical with respect to the common electrode voltage due to factors, such as impedance or after images, etc., in the LCD panel, so the first adjustment parameter and the second adjustment parameter may be different.

1012. The dark-state voltage is adjusted based on the adjustment parameters to obtain the plurality of initial dark-state voltage differences.

The first voltage is adjusted based on the first adjustment parameter. The second voltage is adjusted based on the second adjustment parameter. As a result, the difference between the first voltage and the second voltage is changed to obtain the plurality of initial dark-state voltage differences.

102. A contrast ratio corresponding to each of the initial dark-state voltage differences is obtained based on the plurality of initial dark-state voltage differences.

Figure 3:
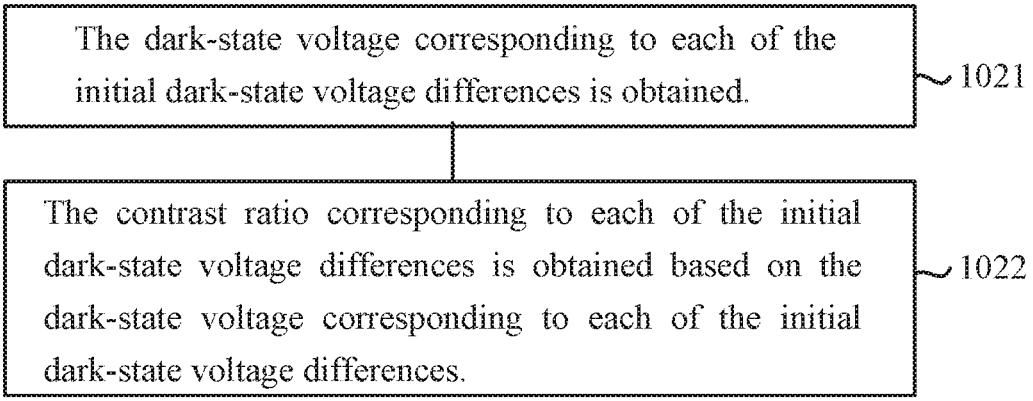
FIG. 3 is a schematic flowchart of step 102 in FIG. 1.

A description is provided with reference to FIG. 3 Step 102 comprises:

1021. The dark-state voltage corresponding to each of the initial dark-state voltage differences is obtained.

As mentioned above, the dark-state voltage comprises the first voltage and the second voltage. The plurality of initial dark-state voltage differences are obtained through adjusting the first voltage and the second voltage. Then, obtaining the dark-state voltage corresponding to each of the initial dark-state voltage differences means obtaining the first voltage and the second voltage corresponding to each of the initial dark-state voltage differences.

1022. The contrast ratio corresponding to each of the initial dark-state voltage differences is obtained based on the dark-state voltage corresponding to each of the initial dark-state voltage differences.

Contrast ratio is the ratio of the brightest brightness (bright-state brightness) to the darkest brightness (dark-state brightness) of a same point on the LCD panel. A high contrast ratio means relatively higher brightness and vividness of the color. It is noted that the luminance of the LCD panel is the dark-state brightness when the dark-state voltage is utilized to drive the LCD panel, and the luminance of the LCD panel is the bright-state brightness when a bright-state voltage (the maximum driving voltage) is utilized to drive the LCD panel.

The dark-state voltage corresponding to each of the initial dark-state voltage differences is utilized to drive the LCD panel to make the LCD panel emit light. Then, an optical sensor is used to measure dark-state brightness of a center area of the LCD panel to obtain a plurality of dark-state brightness values.

In addition, the initial gamma voltage can be adjusted through the target brightness curve to obtain the bright-state voltage of the LCD panel. By utilizing the bright-state voltage to drive the LCD panel, the LCD panel emits light. Then, an optical sensor is used to measure bright-state brightness of the center area of the LCD panel to obtain a bright-state brightness value.

As a result, the contrast ratio corresponding to each of the initial dark-state voltage differences is obtained through a ratio of the bright-state brightness value to the dark-state brightness value.

It is noted that since the contrast ratio specification adopted by the LCD panel is usually the contrast ratio specification at the normal viewing angle, the optical sensor is placed perpendicular to the center area of the LCD panel to collect the dark-state brightness at the normal viewing angle and the bright-state brightness at the normal viewing angle of the LCD panel. However, the present disclosure is not limited in this regard.

103. A reference dark-state voltage difference in the plurality of initial dark-state voltage differences is obtained, and a contrast ratio change corresponding to each of the initial dark-state voltage differences is obtained based on the reference dark-state voltage difference.

The reference dark-state voltage difference may be set depending on practical needs, and the present disclosure is not limited in this regard. In some embodiments, the initial dark-state voltage difference when the dark-state voltage difference is zero can be selected as the reference dark-state voltage difference. When the initial dark-state voltage corresponding to the dark-state voltage difference being zero makes the brightness of the LCD panel the lowest, the contrast ratio of the LCD panel is the best under the circumstances that the bright-state brightness is consistent. Therefore, by taking the initial dark-state voltage difference when the dark-state voltage difference is zero as the reference dark-state voltage difference, the decreased extent of the contrast ratio corresponding to each of the initial dark-state voltage differences can be intuitively reflected.

Figure 4:
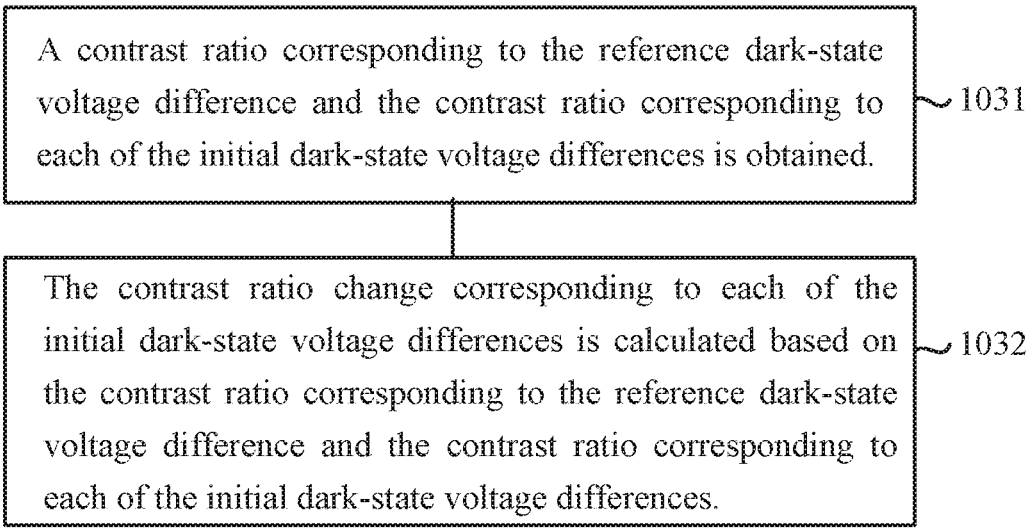
FIG. 4 is a schematic flowchart of step 103 in FIG. 1.

In greater detail, a description is provided with reference to FIG. 4. Step 103 comprises:

1031. A contrast ratio corresponding to the reference dark-state voltage difference and the contrast ratio corresponding to each of the initial dark-state voltage differences is obtained.

After the reference dark-state voltage difference is set, the contrast ratio corresponding to the reference dark-state voltage difference is obtained. At the same time, the contrast ratio corresponding to each of the initial dark-state voltage differences is obtained for use in subsequent steps.

1032. The contrast ratio change corresponding to each of the initial dark-state voltage differences is calculated based on the contrast ratio corresponding to the reference dark-state voltage difference and the contrast ratio corresponding to each of the initial dark-state voltage differences.

The contrast ratio change corresponding to each of the initial dark-state voltage differences may be calculated by using method A. First, a contrast ratio difference between the contrast ratio corresponding to each of the initial dark-state voltage differences and the contrast ratio corresponding to the reference dark-state voltage difference (the former minus the latter) is calculated. Then, a ratio of the contrast ratio difference corresponding to each of the initial dark-state voltage differences to the contrast ratio corresponding to the reference dark-state voltage difference is calculated to obtain the contrast ratio change corresponding to each of the initial dark-state voltage differences.

In method A, a contrast ratio difference between the contrast ratio corresponding to the reference dark-state voltage difference and the contrast ratio corresponding to each of the initial dark-state voltage differences (the former minus the latter) may be calculated. The present disclosure is not limited in this regard.

The obtained contrast ratio change calculated by the above method reflects the change of the contrast ratio corresponding to each of the initial dark-state voltage differences relative to the contrast ratio corresponding to the reference dark-state voltage difference, so as to reflect the changing trend of the contrast ratio of the LCD panel when the dark-state voltage difference changes.

The contrast ratio change corresponding to each of the initial dark-state voltage differences may be calculated by using method B. A ratio of the contrast ratio corresponding to each of the initial dark-state voltage differences to the contrast ratio corresponding to the reference dark-state voltage difference is calculated to obtain the contrast ratio change corresponding to each of the initial dark-state voltage differences.

In method B, a ratio of the contrast ratio corresponding to the reference dark-state voltage difference to the contrast ratio corresponding to each of the initial dark-state voltage differences may be calculated. The present disclosure is not limited in this regard.

This method uses the ratio of the contrast ratio corresponding to each of the initial dark-state voltage differences to the contrast ratio corresponding to the reference dark-state voltage difference to directly reflect the changing trend of the contrast ratio of the LCD panel when the dark-state voltage difference changes. The calculation process is simplified and the operating efficiency is improved.

The above calculation methods of the contrast ratio change corresponding to each of the initial dark-state voltage differences is for illustrative purposes only, and the present disclosure is not limited in this regard. Any calculation method of the contrast ratio change that can reflect the contrast ratio corresponding to each of the initial dark-state voltage differences relative to the contrast ratio corresponding to the reference dark-state voltage difference can be used to realize the technical solution of the present disclosure.

104. The dark-state voltage difference of the LCD panel is determined based on the contrast ratio change corresponding to each of the initial dark-state voltage differences.

After obtaining the contrast ratio change corresponding to each of the initial dark-state voltage differences through step 103, the dark-state voltage difference of the LCD panel that can be set can be determined based on the relationship between the contrast ratio change and the initial dark-state voltage difference.

Figure 5:
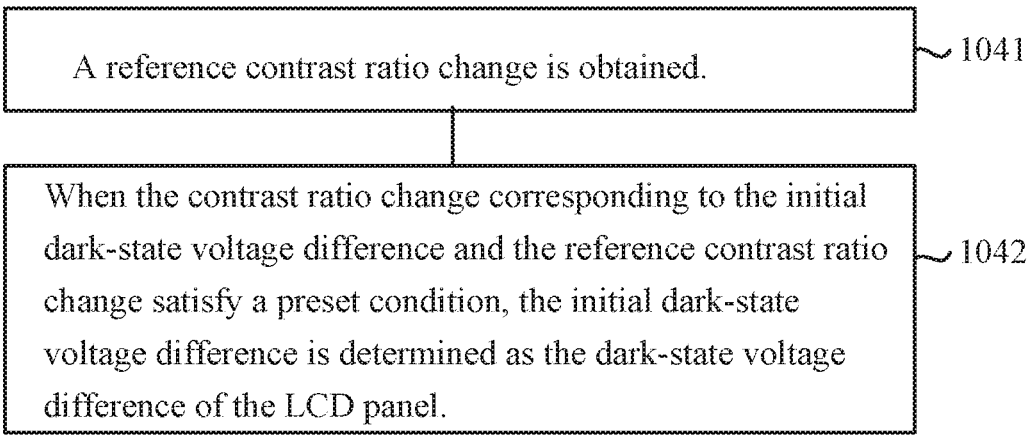
FIG. 5 is a schematic flowchart of step 104 in FIG. 1.

A description is provided with reference to FIG. 5. Step 104 comprises:

1041. A reference contrast ratio change is obtained.

The reference contrast ratio change may be set depending on the specification of the LED panel, and the present disclosure is not limited in this regard. It is thus understood that there are many parameters used to evaluate the LCD panel, including display parameters such as contrast ratio, after image, or picture crosstalk, etc. Generally, the contrast ratio of the LCD panel corresponding to the dark-state voltage difference being zero is better. However, in order to improve display problems, such after image, etc., it is necessary to increase the dark-state voltage difference to a certain extent. Therefore, during the practical manufacturing process, the reference contrast ratio change can be taken within a smaller variation range if the contrast ratio specification is higher among the specification parameters of the LCD panel. If the requirements for display effects, such as after image, etc., are higher among the specification parameters of the LCD panel, the reference contrast ratio change can be taken within a larger variation range that meets the contrast ratio specification. As a result, the situation that the contrast ratio parameter is not qualified can be avoided while improving other display problems to the greatest extent.

1042. When the contrast ratio change corresponding to the initial dark-state voltage difference and the reference contrast ratio change satisfy a preset condition, the initial dark-state voltage difference is determined as the dark-state voltage difference of the LCD panel.

The preset condition may be set based on the calculation method of the contrast ratio change corresponding to the initial dark-state voltage difference and the setting of the reference contrast ratio change.

For example, when the initial dark-state voltage difference corresponding to the highest contrast ratio is used as the reference dark-state voltage difference, under the circumstances that the reference contrast ratio change is X, the preset condition can be set as that any of the initial dark-state voltage differences can be used as the dark-state voltage difference of the LCD panel when the contrast ratio change corresponding to the initial dark-state voltage difference is less than X.

Figure 6A:
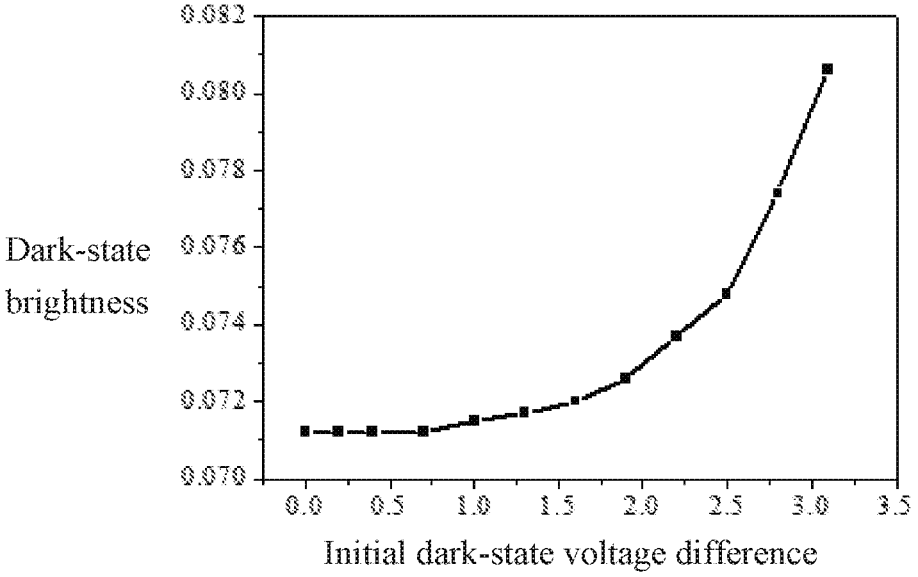
FIG. 6A to FIG. 6C are experimental data curves of a dark-state voltage adjusting method for an LCD panel according to one embodiment of the present disclosure.
Figure 6B:
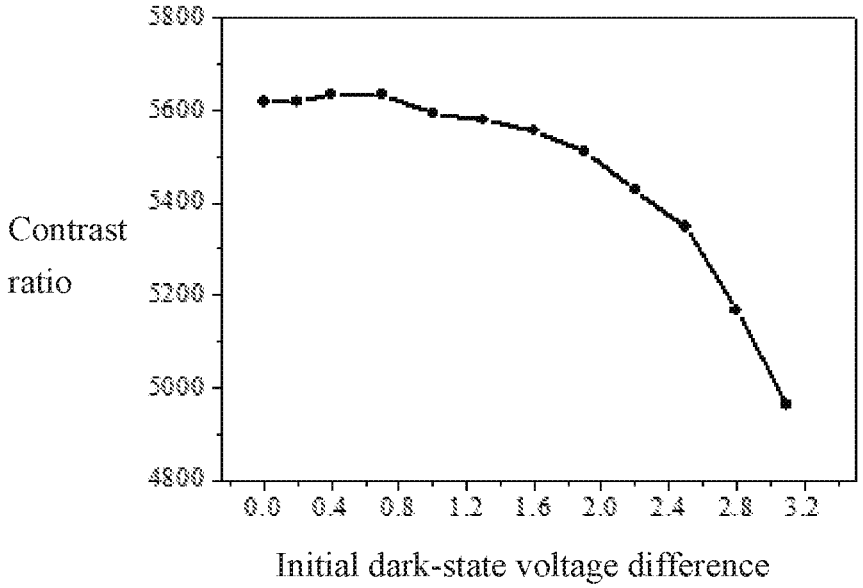
Figure 6C:
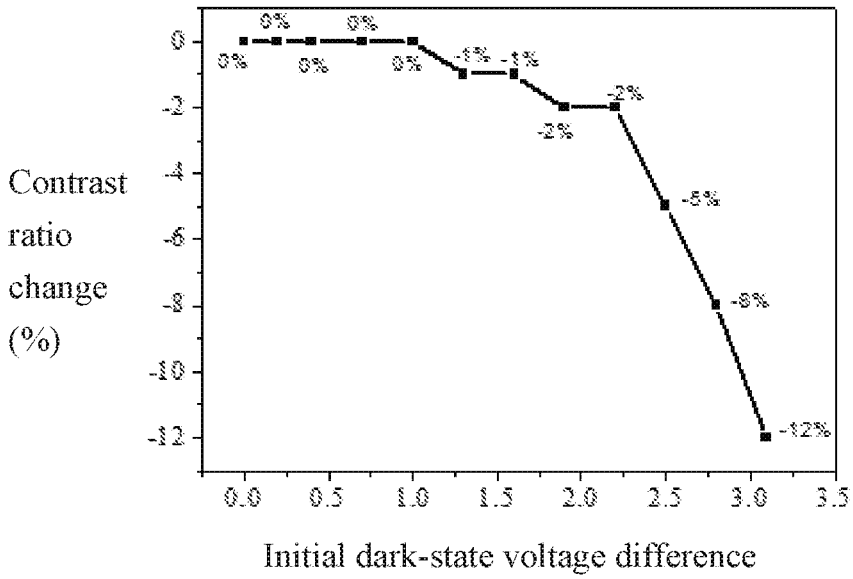

A description is provided with reference to FIG. 6A to FIG. 6C. The embodiment of the present disclosure provides a set of experimental data curves to illustrate the technical solution of the present disclosure in detail.

FIG. 6A is a relationship curve between an initial dark-state voltage difference and dark-state brightness correspondingly according to an embodiment of the present disclosure. The abscissa in FIG. 6A is the initial dark-state voltage difference and the unit is volts (V). The ordinate is the dark-state brightness and the unit is candela/square meter ($cd/m^2$). It should be noted that the initial dark-state voltage difference may be set depending on practical needs.

After obtaining a plurality of initial dark-state voltage differences through adjusting the dark-state voltage, the dark-state voltage corresponding to each of the initial dark-state voltage differences is utilized to drive the LCD panel so as to make the LCD panel emit light. Then, the dark-state brightness corresponding to each of the initial dark-state voltage differences is collected. Since the detailed step can be referred to the foregoing embodiment, a description in this regard is not provided here.

FIG. 6B is a relationship curve between the initial dark-state voltage difference and a contrast ratio correspondingly according to an embodiment of the present disclosure. The abscissa in FIG. 6B is the initial dark-state voltage difference and the unit is volts (V). The ordinate is the contrast ratio. The contrast ratio is the ratio of the bright-state brightness to the dark-state brightness corresponding to each of initial dark-state voltage differences in FIG. 6A of the LCD panel. Since the method of obtaining the bright-state brightness can be referred to the foregoing embodiment, a description in this regard is not provided here.

FIG. 6C is a relationship curve between the initial dark-state voltage difference and a contrast ratio change correspondingly according to an embodiment of the present disclosure. The abscissa in FIG. 6C is the initial dark-state voltage difference and the unit is volts (V). The ordinate is the contrast ratio change. Since the contrast ratio change in the relationship curve is calculated by using the method A described in the above embodiment, a description in this regard is not provided here. The reference dark-state voltage difference is selected to be zero, which is used to find a corresponding contrast ratio in FIG. 6B as the reference contrast ratio, and the contrast ratio change corresponding to each of the initial dark-state voltage differences is obtained through the method A.

Based on the relationship between the contrast ratio change and the initial dark-state voltage difference in FIG. 6C, one reference contrast ratio change can be set, and the dark-state voltage difference of the LCD panel can be determined based on the reference contrast ratio change. In some embodiments, the reference contrast ratio change can be set as 0%, that is, the dark-state voltage differences are set within the range of the highest contrast ratio. As shown in FIG. 6C, all the initial dark-state voltage differences within the range of 1V satisfy the preset condition. In some other embodiments, when comprehensively considering the display parameters in many respects, such as the contrast ratio and the after image of the LCD panel, etc., the reference contrast ratio change can be set as −5%, and the initial dark-state voltage differences corresponding to the contrast ratio change greater than −5% all satisfy the requirement. That is, the initial dark-state voltage differences within the range of 2.5V all satisfy the preset condition. As a result, the situation that the contrast ratio specification can not be achieved is avoided while improving other display problems.

Figure 7:
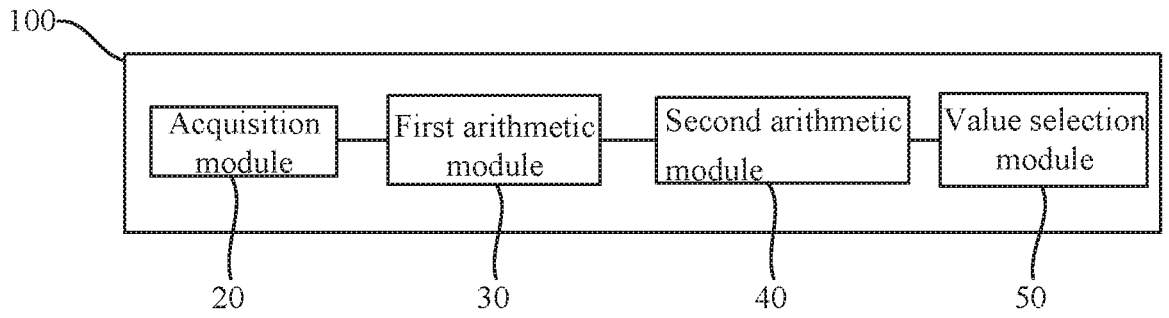
FIG. 7 is a first schematic structure diagram of a dark-state voltage adjusting device for an LCD panel according to one embodiment of the present disclosure.

A description is provided with reference to FIG. 7. The embodiment of the present disclosure further provides a dark-state voltage adjusting device for an LCD panel 100. As shown in FIG. 7, the dark-state voltage adjusting device for the LCD panel 100 comprises an acquisition module 20, a first arithmetic module 30, a second arithmetic module 40, and a value selection module 50. The dark-state voltage adjusting device for the LCD panel 100 is described in detail as follows.

The acquisition module 20 is configured to acquire a plurality of initial dark-state voltage differences. The plurality of initial dark-state voltage differences can be obtained by adjusting a dark-state voltage. The plurality of initial dark-state voltage differences may be set depending on practical needs.

Figure 8:
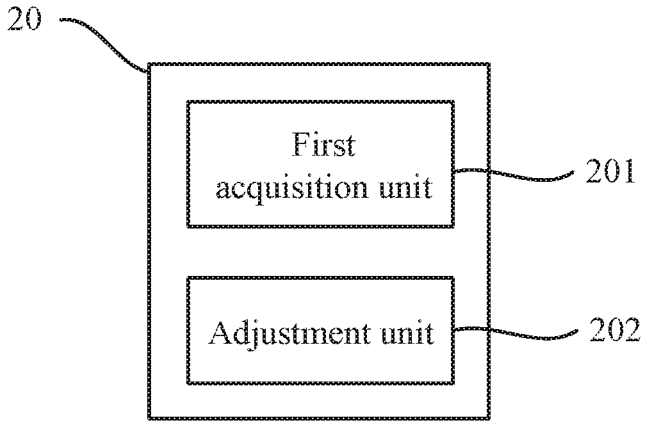
FIG. 8 is a schematic structure diagram of the acquisition module in FIG. 7.

A description is provided with reference to FIG. 8. The acquisition module 20 comprises a first acquisition unit 201 and an adjustment unit 202. The first acquisition unit 201 is configured to acquire adjustment parameters. In some embodiments, the adjustment parameters comprise a first adjustment parameter and a second adjustment parameter. It can be understood that the dark-state voltage comprises a first voltage and a second voltage. The adjustment unit 202 is configured to adjust the first voltage based on the first adjustment parameter and adjust the second voltage based on the second adjustment parameter so as to change a difference between the first voltage and the second voltage to obtain the plurality of initial dark-state voltage differences. It is noted that the first adjustment parameter may be the same as the second first adjustment parameter.

The first arithmetic module 30 is configured to obtain a contrast ratio corresponding to each of the initial dark-state voltage differences based on the plurality of initial dark-state voltage differences.

Figure 9:
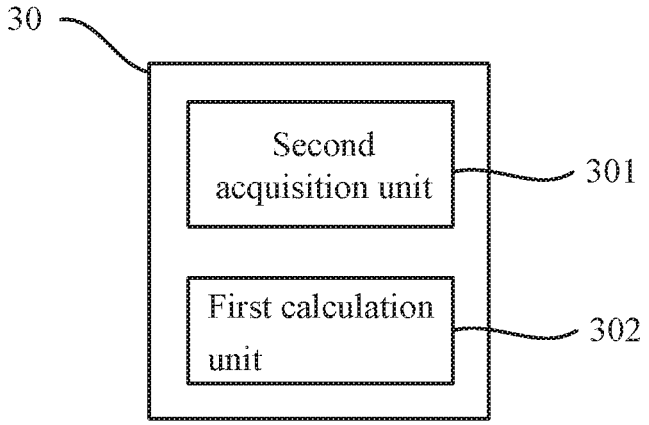
FIG. 9 is a schematic structure diagram of the first arithmetic module in FIG. 7.

A description is provided with reference to FIG. 9. The first arithmetic module 30 comprises a second acquisition unit 301 and a first calculation unit 302. The second acquisition unit 301 is configured to obtain the dark-state voltage corresponding to each of the initial dark-state voltage differences. The first calculation unit 302 is configured to calculate and obtain the contrast ratio corresponding to each of the initial dark-state voltage differences based on the dark-state voltage corresponding to each of the initial dark-state voltage differences. The calculation method of the first calculation unit 302 is to calculate a ratio of bright-state brightness to dark-state brightness corresponding to each of the initial dark-state voltage differences of the LCD panel. Since the description of the bright-state brightness and the dark-state brightness can be referred to the foregoing embodiment, a description in this regard is not provided here.

The second arithmetic module 40 is configured to obtain a reference dark-state voltage difference in the plurality of initial dark-state voltage differences, and obtain a contrast ratio change corresponding to each of the initial dark-state voltage differences based on the reference dark-state voltage difference.

Figure 10:
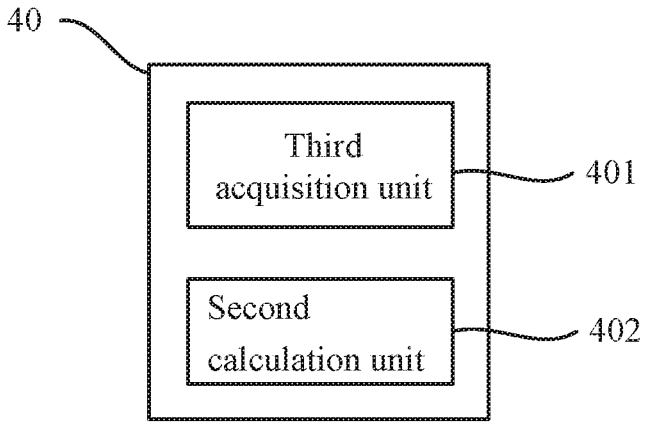
FIG. 10 is a schematic structure diagram of the second arithmetic module in FIG. 7.

A description is provided with reference to FIG. 10. The second arithmetic module 40 comprises a third acquisition unit 401 and a second calculation unit 402. The third acquisition unit 401 is configured to obtain a contrast ratio corresponding to the reference dark-state voltage difference and the contrast ratio corresponding to each of the initial dark-state voltage differences. The second calculation unit 402 is configured to calculate the contrast ratio change corresponding to each of the initial dark-state voltage differences based on the contrast ratio corresponding to the reference dark-state voltage difference and the contrast ratio corresponding to each of the initial dark-state voltage differences. The reference dark-state voltage difference may be set depending on practical needs. The methods for the second calculation unit 402 to calculate the contrast ratio change corresponding to each of the initial dark-state voltage differences include the method A and method B. Since a detailed description can be referred to the foregoing embodiment, a description in this regard is not provided here.

The value selection module 50 is configured to determine a dark-state voltage difference of the LCD panel based on the contrast ratio change corresponding to each of the initial dark-state voltage differences.

Figure 11:
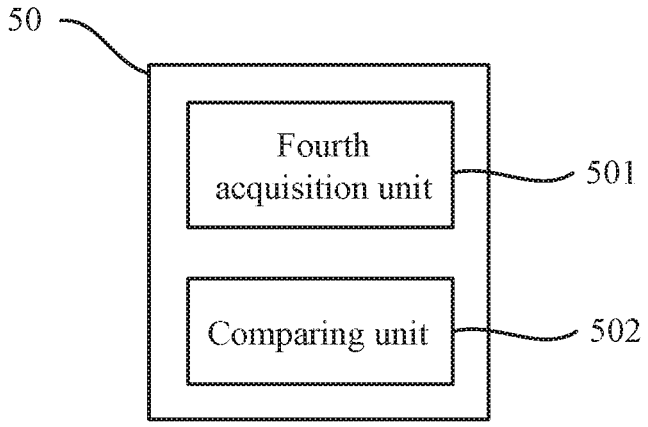
FIG. 11 is a schematic structure diagram of the value selection module in FIG. 7.

In greater detail, a description is provided with reference to FIG. 11. The value selection module 50 comprises a fourth acquisition unit 501 and a comparing unit 502. The fourth acquisition unit 501 is configured to obtain a reference contrast ratio change. The comparing unit 502 is configured to compare the contrast ratio change corresponding to each of the initial dark-state voltage differences with the reference contrast ratio change. When the contrast ratio change corresponding to the initial dark-state voltage difference and the reference contrast ratio change satisfy the preset condition, the initial dark-state voltage difference is determined as the dark-state voltage difference of the LCD panel.

The reference contrast ratio change may be set depending on the specification of the LED panel. The preset condition may be set based on the calculation method of the contrast ratio change corresponding to the initial dark-state voltage difference and the setting of the reference contrast ratio change. The embodiments of the present disclosure are not limited in this regard.

The dark-state voltage adjusting device for the LCD panel 100 according to the embodiment of the present disclosure disposes the acquisition module 20, the first arithmetic module 30, the second arithmetic module 40, and the value selection module 50 to finally obtain the contrast ratio change corresponding to each of the initial dark-state voltage differences. The dark-state voltage difference of the LCD panel is determined through a reference contrast ratio change and the contrast ratio change so as to specify the dark-state voltage difference of the LCD panel. As a result, the contrast ratio is improved.

Those of ordinary skill in the art would understand that all or part of the steps in the various methods of the foregoing embodiments can be completed through instructions, or through relevant hardware controlled by the instructions. The instructions can be stored in a computer readable storage medium and are loaded and executed by a processor.

Therefore, an embodiment of the present disclosure provides a storage medium in which a plurality of instructions are stored. The instructions can be loaded by a processor to perform the steps in any one of the dark-state voltage adjusting methods for the LCD panel according to the embodiments of the present disclosure. That is, the instructions executable by the processor to performs operations of:

obtaining a plurality of initial dark-state voltage differences;

obtaining a contrast ratio corresponding to each of the initial dark-state voltage differences based on the plurality of initial dark-state voltage differences;

obtaining a reference dark-state voltage difference in the plurality of initial dark-state voltage differences, and obtaining a contrast ratio change corresponding to each of the initial dark-state voltage differences based on the reference dark-state voltage difference; and determining a dark-state voltage difference of the LCD panel based on the contrast ratio change corresponding to each of the initial dark-state voltage differences.

Since the detailed implementation of each of the above operations can be referred to the foregoing embodiment, a description in this regard is not provided.

Optionally, the storage medium comprises a Read Only Memory (ROM), a Random Access Memory (RAM) a disk or a compact disc.

Owing to the instructions stored in the storage medium, the steps in any one of the dark-state voltage adjusting methods for the LCD panel according to the embodiments of the present disclosure can be performed. As a result, the beneficial effects that can be achieved by any one of the dark-state voltage adjusting methods for the LCD panel according to the embodiments of the present disclosure can be realized. Since a detailed description can be referred to the foregoing embodiments, a description in this regard is not provided.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. A method for adjusting dark-state voltage applied on a liquid crystal (LCD) panel, the method performed by an electrical device comprising the LCD panel, a processor, and a storage device storing a plurality of instructions executable by the processor, the method comprising:

obtaining, by the processor executing the plurality of instructions, a plurality of initial dark-state voltage differences;

obtaining, by the processor executing the plurality of instructions, a contrast ratio corresponding to each of the initial dark-state voltage differences based on the plurality of initial dark-state voltage differences;

obtaining, by the processor executing the plurality of instructions, a reference dark-state voltage difference in the plurality of initial dark-state voltage differences, and obtaining, by the processor executing the plurality of instructions, a contrast ratio change corresponding to each of the initial dark-state voltage differences based on the reference dark-state voltage difference; and determining, by the processor executing the plurality of instructions, a dark-state voltage difference of the LCD panel based on the contrast ratio change corresponding to each of the initial dark-state voltage differences.

2. The method as claimed in claim 1, wherein the step of obtaining the plurality of initial dark-state voltage differences comprises:

obtaining, by the processor executing the plurality of instructions, adjustment parameters; and adjusting, by the processor executing the plurality of instructions, a dark-state voltage based on the adjustment parameters to obtain the plurality of initial dark-state voltage differences.

3. The method as claimed in claim 1, wherein the step of obtaining the contrast ratio corresponding to each of the initial dark-state voltage differences based on the plurality of initial dark-state voltage differences comprises:

obtaining, by the processor executing the plurality of instructions, the dark-state voltage corresponding to each of the initial dark-state voltage differences; and obtaining, by the processor executing the plurality of instructions, the contrast ratio corresponding to each of the initial dark-state voltage differences based on the dark-state voltage corresponding to each of the initial dark-state voltage differences.

4. The method as claimed in claim 1, wherein the step of obtaining the reference dark-state voltage difference in the plurality of initial dark-state voltage differences, and obtaining the contrast ratio change corresponding to each of the initial dark-state voltage differences based on the reference dark-state voltage difference comprises:

obtaining, by the processor executing the plurality of instructions, a contrast ratio corresponding to the reference dark-state voltage difference and the contrast ratio corresponding to each of the initial dark-state voltage differences; and calculating, by the processor executing the plurality of instructions, the contrast ratio change corresponding to each of the initial dark-state voltage differences based on the contrast ratio corresponding to the reference dark-state voltage difference and the contrast ratio corresponding to each of the initial dark-state voltage differences.

5. The method as claimed in claim 4, wherein the step of calculating the contrast ratio change corresponding to each of the initial dark-state voltage differences based on the contrast ratio corresponding to the reference dark-state voltage difference and the contrast ratio corresponding to each of the initial dark-state voltage differences comprises:

calculating, by the processor executing the plurality of instructions, a contrast ratio difference between the contrast ratio corresponding to each of the initial dark-state voltage differences and the contrast ratio corresponding to the reference dark-state voltage difference; and calculating, by the processor executing the plurality of instructions, a ratio of the contrast ratio difference corresponding to each of the initial dark-state voltage differences to the contrast ratio corresponding to the reference dark-state voltage difference to obtain the contrast ratio change corresponding to each of the initial dark-state voltage differences.

6. The method as claimed in claim 4, wherein the step of calculating the contrast ratio change corresponding to each of the initial dark-state voltage differences based on the contrast ratio corresponding to the reference dark-state voltage difference and the contrast ratio corresponding to each of the initial dark-state voltage differences comprises:

calculating, by the processor executing the plurality of instructions, a ratio of the contrast ratio corresponding to each of the initial dark-state voltage differences to the contrast ratio corresponding to the reference dark-state voltage difference to obtain the contrast ratio change corresponding to each of the initial dark-state voltage differences.

7. The method as claimed in claim 1, wherein the step of determining the dark-state voltage difference of the LCD panel based on the contrast ratio change corresponding to each of the initial dark-state voltage differences comprises:

obtaining, by the processor executing the plurality of instructions, a reference contrast ratio change; and determining, by the processor executing the plurality of instructions, the initial dark-state voltage difference as the dark-state voltage difference of the LCD panel when the contrast ratio change corresponding to the initial dark-state voltage difference and the reference contrast ratio change satisfy a preset condition.

8. A dark-state voltage adjusting device for an LCD panel comprising:

an acquisition module configured to obtain a plurality of initial dark-state voltage differences;

a first arithmetic module configured to obtain a contrast ratio corresponding to each of the initial dark-state voltage differences based on the plurality of initial dark-state voltage differences;

a second arithmetic module configured to obtain a reference dark-state voltage difference in the plurality of initial dark-state voltage differences, and obtain a contrast ratio change corresponding to each of the initial dark-state voltage differences based on the reference dark-state voltage difference; and a value selection module configured to determine a dark-state voltage difference of the LCD panel based on the contrast ratio change corresponding to each of the initial dark-state voltage differences.

9. The dark-state voltage adjusting device as claimed in claim 8, wherein the acquisition module comprises a first acquisition unit and an adjustment unit;

the first acquisition unit being configured to obtain adjustment parameters; and the adjustment unit being configured to adjust a dark-state voltage based on the adjustment parameters to obtain the plurality of initial dark-state voltage differences.

10. The dark-state voltage adjusting device as claimed in claim 8, wherein the first arithmetic module comprises a second acquisition unit and a first calculation unit;

the second acquisition unit being configured to obtain the dark-state voltage corresponding to each of the initial dark-state voltage differences; and the first calculation unit being configured to calculate and obtain the contrast ratio corresponding to each of the initial dark-state voltage differences based on the dark-state voltage corresponding to each of the initial dark-state voltage differences.

11. The dark-state voltage adjusting device as claimed in claim 8, wherein the second arithmetic module comprises a third acquisition unit and a second calculation unit;

the third acquisition unit being configured to obtain a contrast ratio corresponding to the reference dark-state voltage difference and the contrast ratio corresponding to each of the initial dark-state voltage differences; and the second calculation unit being configured to calculate the contrast ratio change corresponding to each of the initial dark-state voltage differences based on the contrast ratio corresponding to the reference dark-state voltage difference and the contrast ratio corresponding to each of the initial dark-state voltage differences.

12. The dark-state voltage adjusting device as claimed in claim 11, wherein the second calculation unit is configured to calculate a contrast ratio difference between the contrast ratio corresponding to each of the initial dark-state voltage differences and the contrast ratio corresponding to the reference dark-state voltage difference; and calculate a ratio of the contrast ratio difference corresponding to each of the initial dark-state voltage differences to the contrast ratio corresponding to the reference dark-state voltage difference to obtain the contrast ratio change corresponding to each of the initial dark-state voltage differences.

13. The dark-state voltage adjusting device as claimed in claim 11, wherein the second calculation unit is configured to calculate a ratio of the contrast ratio corresponding to each of the initial dark-state voltage differences to the contrast ratio corresponding to the reference dark-state voltage difference to obtain the contrast ratio change corresponding to each of the initial dark-state voltage differences.

14. The dark-state voltage adjusting device as claimed in claim 8, wherein the value selection module comprises a fourth acquisition unit and a comparing unit;

the fourth acquisition unit being configured to obtain a reference contrast ratio change; and the comparing unit being configured to compare the contrast ratio change corresponding to each of the initial dark-state voltage differences with the reference contrast ratio change, and determine the initial dark-state voltage difference as the dark-state voltage difference of the LCD panel when the contrast ratio change corresponding to the initial dark-state voltage difference and the reference contrast ratio change satisfy a preset condition.

15. A non-transitory storage medium storing a plurality of instructions, the instructions being adapted to be loaded by a processor to perform operations of:

obtaining, by the processor executing the plurality of instructions, a plurality of initial dark-state voltage differences;

obtaining, by the processor executing the plurality of instructions, a contrast ratio corresponding to each of the initial dark-state voltage differences based on the plurality of initial dark-state voltage differences;

obtaining, by the processor executing the plurality of instructions, a reference dark-state voltage difference in the plurality of initial dark-state voltage differences, and obtaining, by the processor executing the plurality of instructions, a contrast ratio change corresponding to each of the initial dark-state voltage differences based on the reference dark-state voltage difference; and determining, by the processor executing the plurality of instructions, a dark-state voltage difference of the LCD panel based on the contrast ratio change corresponding to each of the initial dark-state voltage differences.

16. The non-transitory storage medium as claimed in claim 15, wherein the operation of obtaining the plurality of initial dark-state voltage differences comprises:

obtaining, by the processor executing the plurality of instructions, adjustment parameters; and adjusting, by the processor executing the plurality of instructions, a dark-state voltage based on the adjustment parameters to obtain the plurality of initial dark-state voltage differences.

17. The non-transitory storage medium as claimed in claim 15, wherein the operation of obtaining the contrast ratio corresponding to each of the initial dark-state voltage differences based on the plurality of initial dark-state voltage differences comprises:

obtaining, by the processor executing the plurality of instructions, the dark-state voltage corresponding to each of the initial dark-state voltage differences; and obtaining, by the processor executing the plurality of instructions, the contrast ratio corresponding to each of the initial dark-state voltage differences based on the dark-state voltage corresponding to each of the initial dark-state voltage differences.

18. The non-transitory storage medium as claimed in claim 15, wherein the operation of obtaining the reference dark-state voltage difference in the plurality of initial dark-state voltage differences, and obtaining the contrast ratio change corresponding to each of the initial dark-state voltage differences based on the reference dark-state voltage difference comprises:

obtaining, by the processor executing the plurality of instructions, a contrast ratio corresponding to the reference dark-state voltage difference and the contrast ratio corresponding to each of the initial dark-state voltage differences; and calculating, by the processor executing the plurality of instructions, the contrast ratio change corresponding to each of the initial dark-state voltage differences based on the contrast ratio corresponding to the reference dark-state voltage difference and the contrast ratio corresponding to each of the initial dark-state voltage differences.

19. The non-transitory storage medium as claimed in claim 18, wherein the operation of calculating the contrast ratio change corresponding to each of the initial dark-state voltage differences based on the contrast ratio corresponding to the reference dark-state voltage difference and the contrast ratio corresponding to each of the initial dark-state voltage differences comprises:

calculating, by the processor executing the plurality of instructions, a contrast ratio difference between the contrast ratio corresponding to each of the initial dark-state voltage differences and the contrast ratio corresponding to the reference dark-state voltage difference; and calculating, by the processor executing the plurality of instructions, a ratio of the contrast ratio difference corresponding to each of the initial dark-state voltage differences to the contrast ratio corresponding to the reference dark-state voltage difference to obtain the contrast ratio change corresponding to each of the initial dark-state voltage differences.

20. The non-transitory storage medium as claimed in claim 15, wherein the operation of determining the dark-state voltage difference of the LCD panel based on the contrast ratio change corresponding to each of the initial dark-state voltage differences comprises:

obtaining, by the processor executing the plurality of instructions, a reference contrast ratio change; and determining, by the processor executing the plurality of instructions, the initial dark-state voltage difference as the dark-state voltage difference of the LCD panel when the contrast ratio change corresponding to the initial dark-state voltage difference and the reference contrast ratio change satisfy a preset condition.

* * * * *